US008094090B2

(12) United States Patent
Fisher et al.

(10) Patent No.: US 8,094,090 B2
(45) Date of Patent: Jan. 10, 2012

(54) REAL-TIME SELF-VISUALIZATION SYSTEM

(75) Inventors: James Brian Fisher, San Antonio, TX (US); Fred Henry Previc, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 791 days.

(21) Appl. No.: 11/875,074

(22) Filed: Oct. 19, 2007

(65) Prior Publication Data

US 2009/0102746 A1 Apr. 23, 2009

(51) Int. Cl.
*G09G 5/00* (2006.01)

(52) U.S. Cl. ..... 345/8; 434/247; 349/11

(58) Field of Classification Search ..... 345/156, 345/8, 7, 9; 349/11, 13; 434/247; 463/1, 463/30, 31, 36; 359/630–633
See application file for complete search history.

(56) References Cited

U.S. PATENT DOCUMENTS 5,815,126 A * 9/1998 Fan et al. ..... 345/8
6,072,494 A * 6/2000 Nguyen ..... 715/863
6,126,449 A 10/2000 Burns
6,166,744 A 12/2000 Jaszlics
6,188,381 B1 2/2001 Van Der Wal
6,633,304 B2 10/2003 Anabuki
6,657,637 B1 12/2003 Inagaki
6,757,068 B2 6/2004 Foxlin
6,917,370 B2 7/2005 Benton
6,966,778 B2 11/2005 Macri
7,053,915 B1 * 5/2006 Jung et al. ..... 345/633
7,095,388 B2 8/2006 Truxa
7,110,909 B2 9/2006 Friedrich
7,145,726 B2 12/2006 Geist
7,162,054 B2 1/2007 Meisner
7,176,936 B2 2/2007 Sauer
7,190,331 B2 3/2007 Genc
7,190,378 B2 3/2007 Sauer
7,193,584 B2 3/2007 Lee
7,215,322 B2 5/2007 Genc
7,227,526 B2 6/2007 Hildreth
7,239,330 B2 7/2007 Sauer
7,259,771 B2 8/2007 Shouji
7,264,554 B2 9/2007 Bentley (Continued)

OTHER PUBLICATIONS

Voida et al., "A Study on the Manipulation of 2D Objects in a Projector/Camera-Based Augmented Reality Environment," SIGCHI Conference of Human Factors in Computing Systems (Proc. of CHI'05) Portland, Oregon, 2005. 10 pages.

(Continued)

*Primary Examiner* — Stephen Sherman
(74) *Attorney, Agent, or Firm* — Grossman, Tucker et al.

(57) ABSTRACT

The present disclosure relates to a system which may allow a user to visualize and/or monitor motor activities during, e.g., rehabilitation exercises and/or athletic training. The system may include a camera that may be configured to capture images of a user performing a motor activity. The system may also include a computer configured to receive the captured images from the camera while the user is performing the motor activity. The computer may be further configured to provide static and dynamic augmentation of the captured images. The system may further include a display for the user. The display may be configured to receive the augmented captured images from the computer and to display the augmented captured images to the user.

22 Claims, 3 Drawing Sheets

U.S. PATENT DOCUMENTS

| | | | | |
|---|---|---|---|---|
| 7,747,311 | B2 * | 6/2010 | Quaid, III | 600/424 |
| 2004/0189675 | A1 * | 9/2004 | Pretlove et al. | 345/633 |
| 2004/0212630 | A1 * | 10/2004 | Hobgood et al. | 345/633 |
| 2006/0239471 | A1 * | 10/2006 | Mao et al. | 381/92 |
| 2007/0182739 | A1 | 8/2007 | Platonov | |
| 2007/0202472 | A1 | 8/2007 | Moritz | |

OTHER PUBLICATIONS

Azuma, et al., "Recent Advances in Augmented Reality," IEEE Computer Graphics and Applications, Nov./Dec. 2001. pp. 34-47.

Huang, et al., "Interactive Multimodal Biofeedback for Task-Oriented Neural Rehabilitation," Engineering in Medicine and Biology Society, 2005. IEEE-EMBS 2005. 27th Annual International Conference, 2005. pp. 2547-2550.

Azuma, "A Survey of Augmented Reality," Presence: Teleoperators and Virtual Environments 6, 4 (Aug. 1997). pp. 355-385.

Wann et al., "Virtual Reality Displays: What do we know about health issues?" Computer Graphics, (1997) 31(2). pp. 53-57.

Cakmakci, et al., "Head-Worn Displays: A Review," Journal of Display Technology, vol. 2, No. 3, Sep. 2006. pp. 199-216.

* cited by examiner

REAL-TIME SELF-VISUALIZATION SYSTEM

FIELD OF THE INVENTION

This disclosure relates to a system, method and article that captures images of a user performing a motor activity. The images may include static and dynamic augmentation of the captured images such as fixed and moving visual target references. A user may then configure a particular motor activity relative to the target references to assist in rehabilitation and/or athletic training.

BACKGROUND

Humans are generally poor at visualizing their bodies using their kinesthetic sense alone, especially when in action, making it relatively difficult to learn or practice motor skills. As used herein, kinesthetic sense may be understood to mean the sense of position and movement of a person's musculoskeleton derived from the person's muscles, i.e., not from seeing the position and movement. Kinesthetic sense may also be termed muscle sense. Research has shown that visual cues can improve motor skill development. A variety of techniques have been applied to whole-body visualization including the use of mirrors, video displays, motion capture and video capture/analysis. However, none of these techniques provides real-time feedback while the user performs a motion in a natural manner. Training methods that make use of post-performance assessment, such as video analysis, are particularly problematic, since the human short-term kinesthetic memory may be very brief.

SUMMARY

The present disclosure relates in one embodiment to a system comprising a camera configured to capture images of a user performing a motor activity. The system includes a computer configured to receive the captured images from the camera while the user is performing the motor activity. The computer is further configured to provide static and dynamic augmentation of the captured images. The system further includes a display for the user. The display may be configured to receive the augmented captured images from the computer and to display the augmented captured images to the user.

The present disclosure relates in another embodiment to a method for allowing a user to visualize a motor activity. The method comprises positioning a camera configured to capture images of a user performing a motor activity. The captured images are then supplied to a computer. The method includes providing a display for the user wherein the display is configured to receive images from the computer. The computer is configured to supply static and dynamic augmentation of the captured images from the camera to the display.

In yet another embodiment, the present disclosure relates to an article comprising a storage medium having stored thereon instructions that when executed by a machine result in the following operations: receiving captured images of a user performing a motor activity; providing static and dynamic augmentation to the captured images; and outputting to a display augmented captured images wherein the augmented captured images include static and dynamic augmentation.

BRIEF DESCRIPTION OF THE DRAWINGS

The detailed description below may be better understood with reference to the accompanying figures which are provided for illustrative purposes and are not to be considered as limiting any aspect of the invention.

DETAILED DESCRIPTION

In general, the present disclosure describes a system and method that may allow a user to view and/or monitor his or her actions from one or more perspectives, in real-time, while performing a motor activity. A motor activity may be understood as physical movement by the user, such as movement of a spine, arm, legs, feet, hand, fingers, neck, jaw, head, etc. This view or views may be augmented with visual cues that may assist the user in completing the motor activity. For example, a visual cue may define an ideal motion and/or provide real-time feedback regarding any user deviation from the ideal motion. The system may include a display, such as a head worn display (e.g., see-through head mounted display), a camera (e.g., web camera), a personal computer (e.g., laptop) and/or system software.

Figure 1A:
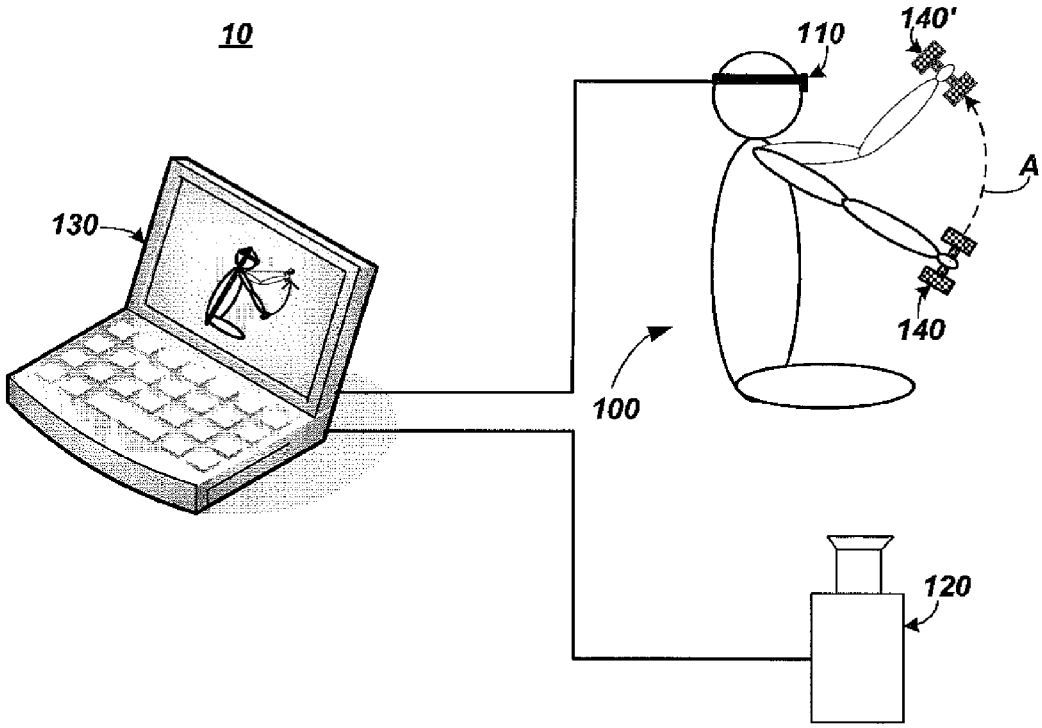
FIGS. 1A and 1B depict two aspects of an embodiment consistent with the present disclosure.

Attention is directed to FIG. 1A which depicts an illustrative embodiment of a real-time self-visualization system 10. The system 10 may include a display for a user, such as a head worn display (HMD) 110, camera 120, and computer 130. Accordingly, a display herein may be understood as a screen or other visual reporting device that provides an image to a user.

The HMD 110 and the camera 120 may be connected to the computer 130. A user 100 is partially depicted in ellipsoidal form. The user 100 may be wearing the HMD 110. As shown in FIG. 1A, for example, the user 100 may be performing a shoulder rehabilitation exercise. The exercise may include moving an object, e.g., weight 140. Both the initial weight position 140 and a later weight position 140' are shown. An actual path between the initial weight position 140 and the later weight position 140' is indicated by dotted arrow A.

The HMD 110 may be relatively low cost and may be monocular. In other words, the HMD 110 may display an augmented image (e.g., 15 of FIG. 1B) to one of the user's 100 eyes. An augmented image is an image that includes additional information other than what may be provided by the camera 120. The HMD 110 may display the augmented image 15 to either the user's 100 left eye or right eye. The user 100 may select which eye receives the augmented image 15. The HMD 110 may further include a flexible mount. The flexible mount may facilitate moving the display of the augmented image 15 from one eye to the other. The flexible mount may enhance the comfort of the user 100 while the user is wearing the HMD 110. The flexible mount may also accommodate different users with a range of head sizes. The HMD 110 may be relatively lightweight to further enhance a user's comfort.

In an embodiment, the HMD 110 may be an optical see-through type. Accordingly, the user 100 may see his or her surroundings through the augmented image 15. In other words, the augmented image 15 may be projected on a transparent or semitransparent lens, for example, in front of one the user's 100 eyes. With this eye, the user 100 may then perceive both the augmented image 15 and his or her surroundings beyond the augmented image 15. The user 100 may also perceive his or her surroundings with his or her other eye that is not perceiving the augmented image 15. In another embodiment, the HMD 110 may be occluded. In this embodiment, the user 100 may see only the augmented image 15 projected on an occluded or opaque lens in front of one of his or her eyes. The user 100 may then see his or her surroundings only with his or her other eye.

In another embodiment, the HMD 110 may be a video see-through type. In this embodiment, the user 100 may "see" his or her surroundings through the augmented image 15. A video camera mounted on the user's 100 head or on the HMD 110 may capture an image of the user's surroundings. This view of the user's 100 surroundings may be combined with the augmented image 15 and displayed on a video monitor (i.e., the video monitor may be part of the HMD 110) in front of one of the user's 100 eyes. The user 100 may also perceive his or her surroundings with his or her other eye, i.e., the eye that is not perceiving the augmented image 15. In another embodiment, the HMD 110 may be occluded. In this embodiment, the user 100 may see only the augmented image 15 displayed on the video monitor in front of one of his or her eyes. The user 100 may then see his or her surroundings only with his or her other eye.

The HMD 110 may be capable of variable focus. In other words, the focus of the augmented image 15 may be adjustable by the user 100. It may be appreciated that variable focus may be useful for accommodating different users. Similarly, the HMD 110 may be capable of variable brightness. Variable brightness may accommodate different users. Variable brightness may also accommodate differences in ambient lighting over a range of environments.

The HMD 110 may be further capable of receiving either analog or digital video input signals. The HMD 110 may be configured to receive these signals either over wires ("hard-wired") or wirelessly. Wireless may be IEEE 802.11b, g, n or y, or may be infrared, for example. In an embodiment, the HMD 110 may include VGA and/or SVGA input ports configured to receive video signals from computer 130. It may be appreciated that SVGA as used herein includes resolution of at least 800×600 4-bit pixels, i.e., capable of sixteen colors. In other embodiments, the HMD 110 may include digital video input ports, e.g., USB and/or a Digital Visual Interface.

In another embodiment the HMD 110 and the computer 130 may be combined as a wearable computer. Such wearable computer may then provide a tetherless (wireless) display system to the user 100. In this embodiment, the user 100 may wear the wearable computer so that its display is visible to the user 100 during performance of an activity but does not interfere with the activity. It may also be appreciated that the wearable computer may be a separate component from the HMD 110, but nonetheless wearable on the user.

The self-visualization system 10 may include one or more cameras 120. Each camera 120 may capture a view of the user 100 as the user 100 performs a designated motor activity, e.g., the shoulder rehabilitation exercise depicted in FIGS. 1A and 1B. Each camera 120 may be a video camera, e.g., a web camera ("webcam"). As used herein, a webcam may be understood to mean a real-time video camera that continuously directly uploads captured images to a computer, e.g., computer 130, in real time. The images, and therefore the camera 120, may be digital or analog. If the images are analog, they may be converted to digital representations by a video capture circuit prior to being uploaded to the computer 130. In another embodiment, the video capture circuit may be included in the computer 130.

Each camera 120 may be freely placed in the environment of the user 100 to facilitate capturing a view or views of the user 100 from a desired perspective or perspectives. Each camera 120 may provide a representation of the captured view to the computer 130 for selection, augmentation, further processing and/or presentation to the HMD 110. Selection of the captured view for augmentation, further processing and/or presentation to the HMD 110 may be performed manually by the user 100 or may be done automatically as will be discussed in more detail below. Each camera 120 may be electrically connected to the computer 130 either through wires or wirelessly, e.g., using IEEE 802.11a, b, g, n, or y wireless protocols.

The computer 130 may process video signals from each camera 120. In one embodiment, the computer 130 may be a laptop computer. The computer 130 may provide an interface between each camera 120 and the HMD 110. As noted above, the computer 130 may provide the capabilities of augmenting the view or views of the user 100 captured by the camera 120 (or cameras) and presenting the augmented view or views to the HMD 110. The computer 130 may further include a graphical user interface ("GUI"). The GUI may allow an instructor and/or physician or the like, to augment the views with various visual overlays. The augmented views, e.g., augmented image 15, may be provided to the user 100 via the HMD 110. This augmentation will be discussed in more detail below.

Real-time self-visualization system 10 functionality or selected portions thereof, e.g., GUI, reception of image from each camera 120, selection of the image to augment, image augmentation, and/or provision of augmented image to HMD 110, may be provided by software implemented on computer 130. In an embodiment, the software may be configured to process an image or images from each camera 120. In an embodiment, the software may be configured to select a camera having an image that meets certain predefined criteria, e.g., specifically marked object visible. Further, the software may be configured to scale the image to fit the HMD 110 or to fit a particular visual overlay.

In another embodiment, the software may be configured to determine the position and/or motion of a specifically marked object, e.g., weight 140, held by the user 100. In an embodiment, the software may be configured to compare the detected position and/or motion of the specifically marked object with a desired position and/or motion, as may be defined by an instructor and/or physician or the like. The software in this embodiment may be further configured to generate an output, i.e., alert signal, if the detected position and/or motion deviates from the desired position and/or motion by more than a specified tolerance. Accordingly, a specified tolerance may be understood herein as an acceptable difference between the object's actual position and/or motion (provided by the user) and a desired position and/or motion (speed) for the object.

Figure 1B:
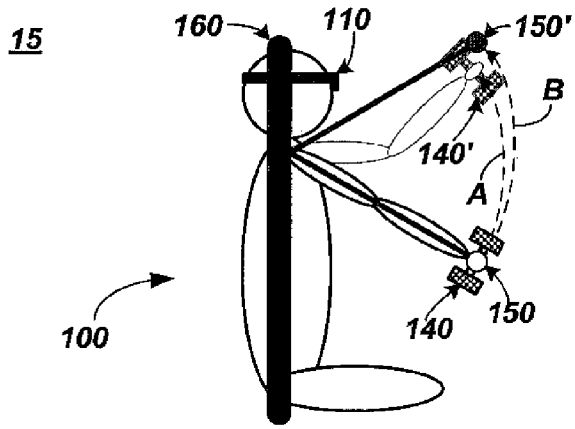

Attention is directed to FIG. 1B which depicts an illustrative augmented image 15 of user 100 during performance of a shoulder rehabilitation exercise. In FIGS. 1A and 1B, like reference designators indicate like elements. In some embodiments, an augmented image 15 may have static and/or dynamic components. In some embodiments, the dynamic components may further include object tracking. In general, static and/or dynamic augmentation may be specified by an instructor and/or physician or the like, using a GUI, implemented on a computer, e.g., computer 130. The augmentation may be user-specific or may be general, from a library or database of augmentation examples.

An augmentation process may include capturing an image of the user 100, providing the captured image to the computer 130, augmenting the captured image, providing the augmented captured image to the HMD 110 for display to the user 100 and repeating for each subsequent image. In some embodiments, augmenting the captured image may further include processing the captured image to facilitate object tracking (as will be discussed in more detail below). The augmentation may be accomplished in real time. Reference to real time augmentation may therefore be understood as augmentation that updates at a rate that a user may perceive as relatively continuous, i.e., updates every 100 milliseconds or less, such as every 90 milliseconds, 80 milliseconds, etc. Accordingly, it is contemplated that updates may be provided between 1-100 milliseconds, including all values and increments therein.

In some embodiments, static augmentation may include a line, area or arc that may be overlaid on an image that includes the user 100. Accordingly, static augmentation may be understood as a fixed visual reference that is applied to captured images. In an embodiment, a line may define a desired body position, e.g., posture indicator 160. The user 100 may self-assess and may adjust his or her position relative to the static visual indicator 160. In another embodiment, an arc, e.g., arc B, may define a desired path for a user-held object, e.g., weight 140. An area may also define a desired starting position, e.g., area 150 and a desired stopping position, e.g., area 150'. The user 100 may again self-assess and attempt to adjust his or her position relative to the static visual indicators 150 and 150'. It may be appreciated that, for the example depicted in FIG. 1B, the user 100 was successful in matching the desired starting position 150 but was not successful in matching the arc B, nor the stopping position 150'.

Dynamic augmentation may include animated lines, areas and/or arcs, for example, that may be overlaid on images that include the user 100. Accordingly, dynamic augmentation may be understood as a moving visual reference (speed and position) that is applied to the captured images and which the user 100 attempts to track. Dynamic augmentation may define any desired motion of an object, e.g., weight 140 lifted by user 100, over time. Desired motion may include a desired position over time and/or a desired speed of a moving target.

For example, target 150, which may be understood as any on-screen moving visual reference, may define a starting position. An image of user 100 may be captured by camera 120 and provided to computer 130. Target 150 may be overlaid on the image of user 100 and the overlaid image may be provided to the HMD 110. The user 100 may then match the position of the target 150 with the weight 140. The target 150 may then move along arc B at a speed defined by an instructor and/or physician. The user 100 may perceive the movement of the target 150 in the overlaid image in the HMD 110. The user 100 may self-assess and adjust relative to the visual indicator, i.e., attempt to match the speed and position of the target 150 as it traverses the arc B. As shown in FIG. 1B, the user 100 may not be completely successful and may achieve a final weight position 140' that is not the same as a final target position 150'.

In another embodiment, dynamic augmentation may further include object tracking. In this embodiment, the user's 100 performance in tracking the target 150 as it traverses the arc B may be monitored by the software implemented on the computer 130. In this manner, the user's 100 performance may be monitored in real-time. For example, an object, e.g., weight 140, may be marked with a relatively distinct color and/or pattern. The color and/or pattern may be relatively easily recognized in an image captured by the camera 120. An image tracking algorithm may then determine the actual position of the object, e.g., weight 140, and compare this position to the desired position of the target 150.

For example, the image tracking algorithm may monitor an actual path, e.g., arc A and compare it to a desired path, e.g., arc B. This comparison may be performed in real-time. If the actual position and the desired position differ by more than a specified amount, the user 100 may be alerted. Alerts may include visual cues that may be displayed to the user 100, e.g., in the augmented image 15 displayed in the HMD 110. In an embodiment, the target may change color, e.g., target 150 versus target 150'. In addition, the target may flash (turn on and off). In another embodiment, the desired path may change color and/or flash on and off, should a user deviate from the path, e.g. arc B. In a still further embodiment, the alert may include audible cues to the user 100. The audible cue may increase in intensity as the difference between desired position and actual position increases.

In another embodiment, the augmented image 15 may be recorded and stored in computer memory. The recorded image may then be available for playback at a later time by the instructor and/or physician. This may then allow the instructor and/or physician to assess the user's 100 performance of the motor activity at a later time.

In another embodiment, information regarding a user's 100 performance of a motor activity may be detected, stored in the computer and made available to the instructor and/or physician. Such information may aid the instructor and/or physician in assessing the progress of the user 100 in the performance of the motor activities over time. Such information may therefore include: user identifier, date, activity identifier, and/or activity specific parameters. Activity specific parameters may include (for a shoulder exercise) the weight of object, maximum angle of rotation (desired and actual), speed of rotation (desired and actual), maximum deviation of actual from desired, number of times actual outside of desired tolerance, etc. Therefore it may be appreciated that the computer may report on the progress of a user's motor activity, which may be understood as first providing a historical review of a user's performance for a given motor activity. In addition, such historical review may be compared to a desired performance criterion for a given user, that may have been previously identified/stored by the system, and the computer may then output such comparison when prompted.

Figure 2:
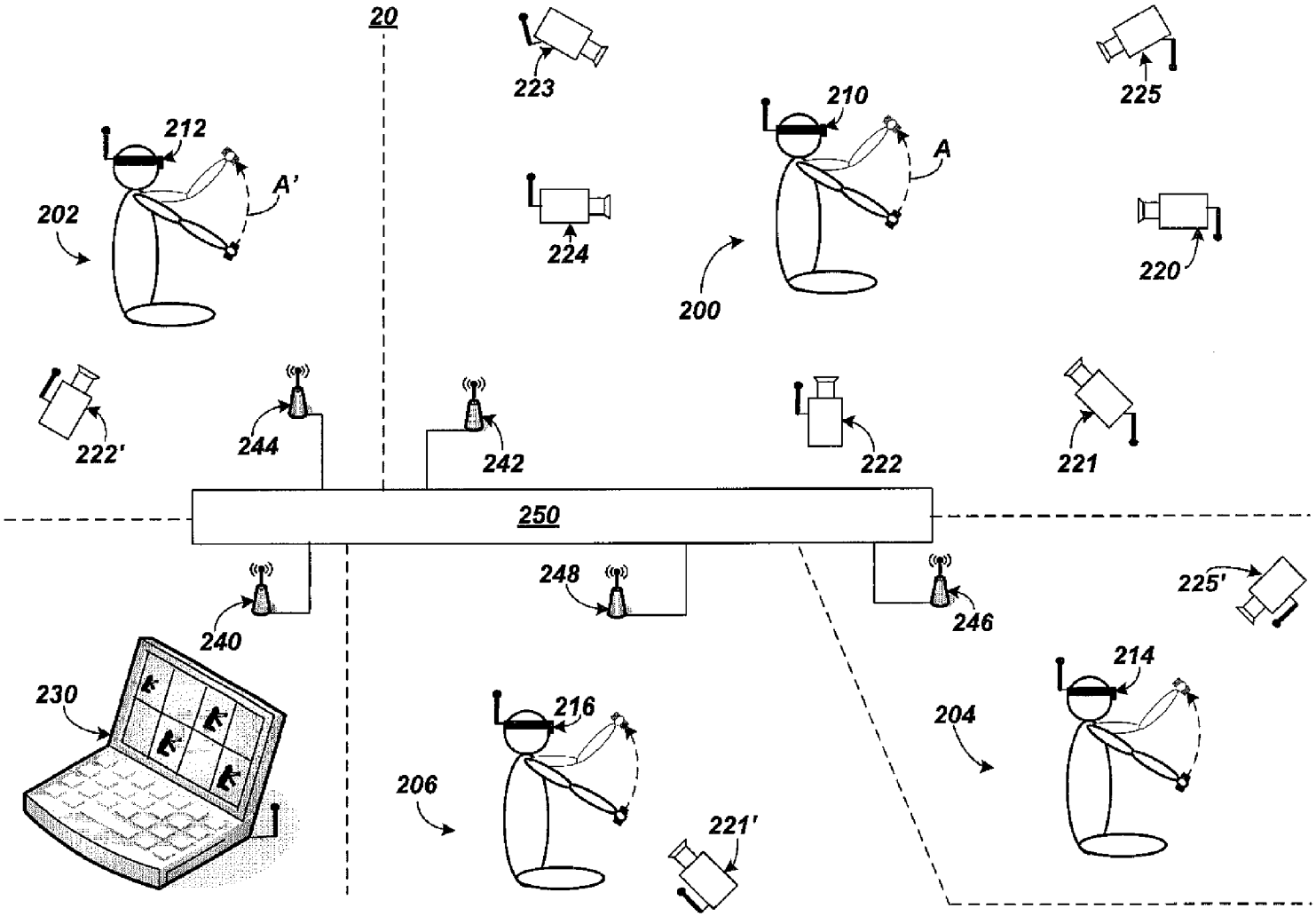
FIG. 2 depicts another embodiment consistent with the present disclosure that may include multiple users connected to a remote instructor over a network.

Attention is directed to FIG. 2 which depicts another embodiment of a real-time self-visualization system 20 consistent with the present disclosure. This embodiment may allow an instructor and/or physician (not shown) to train and/or monitor multiple users locally and/or remotely. The system 20 may include a computer 230 capable of wireless communication (e.g., IEEE 802.11b, g, n or y), one or more wireless access points, e.g., 240, 242, 244, 246, 248 and a network 250. The network 250 may be a local area network, a wide area network, and/or the internet and may therefore be understood as a multi-user communication medium.

Real-time self-visualization system 20 functionality or selected portions thereof may be provided by software implemented on computer 230. In an embodiment, the software may be configured to process data (input and/or output) for one or more users 200, 202, 204, 206, in real time. The GUI may be configured to allow the instructor and/or physician to select the display of multiple users, in parallel. Each user 200, 202, 204, 206, may be performing a unique motor activity or multiple users may be performing similar motor activities. Each user 200, 202, 204, 206, may have an associated display, e.g., HMD 210, 212, 214, 216, and at least one camera, e.g., cameras 222, 222', 225', 221'.

The HMDs 210, 212, 214, 216, and the cameras 222, 222', 225', 221', may be capable of wireless communication with their associated wireless access points, e.g., 242, 244, 246, 248. The wireless access points 242, 244, 246, 248, may then provide communication access to the network 250. Accordingly, the network 250 may provide the communication interconnect between the computer 230 and the cameras, e.g., 222, 222', 225', 221', and computer 230 and the HMDs 210, 212, 214, 216. Although wireless communication is shown in FIG. 2, in another embodiment, the connections may be wired.

It may be appreciated that an instructor and/or physician may monitor multiple users with an embodiment such as that shown in FIG. 2. It may also be appreciated that, for a user (e.g., user 200) with multiple cameras 220, 221, 222, 223, 224, 225, and therefore multiple views, the instructor and/or physician may also select which image (e.g., the image captured by camera 220, 221, 222, 223, 224, or 225) to display, augment and/or provide to the user 200. In another embodiment, the user 200 may select the view (i.e., camera that is provided to the instructor and/or physician and then to the user 200).

Figure 3:
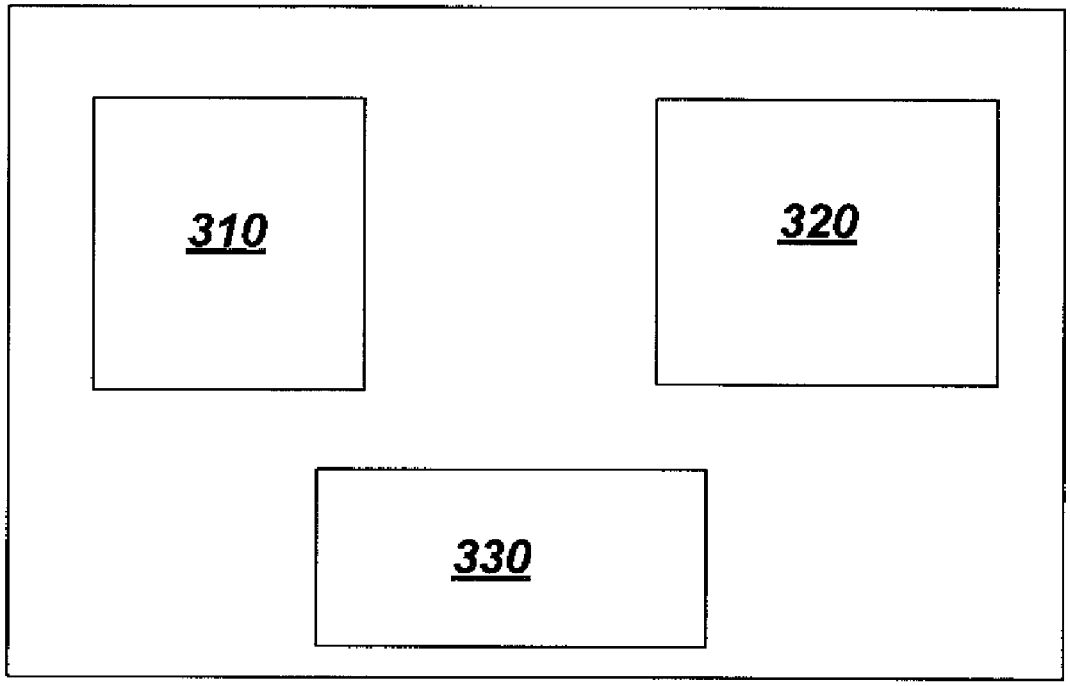
FIG. 3 illustrates an example of a real-time self-visualization system that contains a processor, machine readable media and a user interface.

It should also be appreciated that the functionality described herein for the embodiments of the present invention may be implemented by using hardware, software, or a combination of hardware and software, as desired. If implemented by software, a processor and a machine readable medium are required. The processor may be any type of processor capable of providing the speed and functionality required by the embodiments of the invention. Machine-readable memory includes any media capable of storing instructions adapted to be executed by a processor. Some examples of such memory include, but are not limited to, read-only memory (ROM), random-access memory (RAM), programmable ROM (PROM), erasable programmable ROM (EPROM), electronically erasable programmable ROM (EEPROM), dynamic RAM (DRAM), magnetic disk (e.g., floppy disk and hard drive), optical disk (e.g. CD-ROM), and any other device that can store digital information. The instructions may be stored on a medium in either a compressed and/or encrypted format. Accordingly, in the broad context of the present invention, and with attention to FIG. 3, the system for allowing a user to visualize and monitor, in real time, motor activities during rehabilitation exercises or athletic training may contain a processor (310) and machine readable media (320) and user interface (330).

Although illustrative embodiments and methods have been shown and described, a wide range of modifications, changes, and substitutions is contemplated in the foregoing disclosure and in some instances some features of the embodiments or steps of the method may be employed without a corresponding use of other features or steps. Accordingly, it is appropriate that the claims be construed broadly and in a manner consistent with the scope of the embodiments disclosed herein.

What is claimed is:

1. A system comprising:

a camera configured to capture images of a user performing a motor activity;

a computer configured to receive said captured images from said camera while said user is performing said motor activity wherein said computer is further configured to provide static and dynamic augmentation of said captured images; and a head worn display for said user wherein said display is configured to receive said augmented captured images from said computer and to display said augmented captured images to said user, wherein said display comprises:

a monocular head worn display configured to display said augmented captured images to one of said user's eyes, further including a flexible mount for moving said display from one of said user's eyes to another of said user's eyes, and comprising a video monitor wherein said augmented captured images are displayed on said video monitor, and is further characterized as being a see-through type configured to allow said user to perceive said user's surroundings through said augmented captured images in said display, wherein said user's surroundings are captured by a video camera mounted to at least one of the head worn display and a head of the user; and wherein said user's motor activity includes movement of a specifically marked object and said system detects a motion of said specifically marked object, compares said specifically marked object motion to a target motion and provides an alert to said user if said specifically marked object motion and said target motion differ by more than a specified tolerance.

2. The system of claim 1 wherein said static augmentation comprises a fixed visual reference on said captured images.

3. The system of claim 1 wherein said dynamic augmentation comprises a moving visual reference on said captured images.

4. The system of claim 1 wherein said moving visual reference comprises a moving target.

5. The system of claim 1 wherein said alert is visible or audible to said user.

6. The system of claim 1 wherein said camera, computer and display are configured to communicate over a network.

7. The system of claim 1 further comprising:

a plurality of cameras configured to capture images of a plurality of users each performing a motor activity wherein said computer is further configured to receive said captured images from each of said plurality of cameras, a plurality of displays for said plurality of users wherein each of said plurality of displays is configured to receive augmented captured images from said computer, wherein said augmented captured images include static and dynamic augmentation.

8. The system of claim 7 wherein said plurality of cameras and plurality of displays are configured to communicate over a network to said computer.

9. The system of claim 1 wherein said computer is configured to store said captured images of said user's motor activity.

10. The system of claim 9 wherein said computer is configured to compare said stored captured images to a desired performance criterion for said user.

11. The system of claim 1 wherein said video monitor is a see-through type.

12. A method for allowing a user to visualize a motor activity comprising:

positioning a camera configured to capture images of a user performing a motor activity wherein said images are supplied to a computer and the user's motor activity includes movement of a specifically marked object;

providing a head worn display for said user wherein said display is configured to receive images from said computer;

wherein said computer is configured to supply static and dynamic augmentation of said captured images from said camera to said head worn display, wherein said head worn display comprises:

a monocular head worn display configured to display said augmented captured images to one of said user's eyes, further including a flexible mount for moving said display from one of said user's eyes to another of said user's eyes, and comprising a video monitor wherein said augmented captured images are displayed on said video monitor, and is further characterized as being a see-through type configured to allow said user to perceive said user's surroundings through said augmented captured images in said display, wherein said user's surroundings are captured by a video camera mounted to at least one of the head worn display and a head of the user;

detecting a motion of said specifically marked object;

comparing said specifically marked object motion to a target motion; and provides an alert to said user if said specifically marked object motion and said target motion differ by more than a specified tolerance.

13. The method of claim 12 wherein said static augmentation comprises placing a fixed visual reference on said captured images.

14. The method of claim 12 wherein said dynamic augmentation comprises placing a moving visual reference on said captured images.

15. The method of claim 12 further comprising storing said captured images of said user's motor activity.

16. The method of claim 15 further comprising inputting a performance criterion for a user to said computer and comparing said stored captured images to said desired performance criterion for said user.

17. The method of claim 12 wherein said video monitor is a see-through type.

18. An article comprising a storage medium having stored thereon instructions that when executed by a machine result in the following operations:

receiving captured images of a user performing a motor activity the user's motor activity including movement of a specifically marked object;

detecting a motion of said specifically marked object;

comparing said specifically marked object motion to a target motion;

providing static and dynamic augmentation to said captured images; and outputting to a head worn display augmented captured images wherein said augmented captured images include said static and dynamic augmentation, wherein said head worn display is:

a monocular head worn display configured to display said augmented captured images to one of said user's eyes, further including a flexible mount for moving said display from one of said user's eyes to another of said user's eyes, comprising a video monitor wherein said augmented captured images are displayed on said video monitor, and is further characterized as being a see-through type configured to allow said user to perceive said user's surroundings through said augmented captured images in said display, wherein said user's surroundings are captured by a video camera mounted to at least one of the head worn display and a head of the user; and providing an alert to said user if said specifically marked object motion and said target motion differ by more than a specified tolerance.

19. The article of claim 18 wherein static augmentation comprises a fixed visual reference on said captured images.

20. The article of claim 18 wherein said dynamic augmentation comprises a moving visual reference on said captured images.

21. The article of claim 18 said instructions when executed include detecting an actual position of an object moved by a user and comparing said actual position to a desired position for said object and providing an alert to said user if said actual position and said desired position differ by more than a specified tolerance.

22. The article of claim 18 wherein said video monitor is a see-through type.

* * * * *